United States Patent [19]

Brandt et al.

[11] 4,364,711

[45] Dec. 21, 1982

[54] FOLDING BOAT PROPELLER

[75] Inventors: Lennart H. Brandt, Fjäras; Ingvar O. Hultmark, Hisings Kärra; Lars H. Petersson, Torslanda; Carl U. Söderbaum, Askim, all of Sweden

[73] Assignee: AB Volvo Penta, Goteborg, Sweden

[21] Appl. No.: 224,799

[22] Filed: Jan. 13, 1981

[30] Foreign Application Priority Data

Jan. 16, 1980 [SE] Sweden ..... 8000362

[51] Int. Cl.[3] ..... B63H 1/24

[52] U.S. Cl. ..... 416/142; 416/43; 416/166; 416/212 R

[58] Field of Search ..... 416/142 A, 166, 212 R, 416/142 R, 43

[56] References Cited

U.S. PATENT DOCUMENTS

| | | | |
|---|---|---|---|
| 866,369 | 9/1907 | Learnard | 416/142 A |
| 938,291 | 10/1909 | Thompson | 416/142 A |
| 993,126 | 5/1911 | Thompson | 416/142 A |
| 997,884 | 7/1911 | Wells | 416/142 A |
| 2,528,609 | 11/1950 | Rouse | 416/142 A |
| 4,140,434 | 2/1979 | Bianchi | 416/142 A X |
| 4,242,049 | 12/1980 | Forsling et al. | 416/142 A |

FOREIGN PATENT DOCUMENTS

| | | | |
|---|---|---|---|
| 2916944 | 11/1980 | Fed. Rep. of Germany | 416/142 A |
| 26090 | of 1909 | United Kingdom | 416/142 A |
| 878852 | 10/1961 | United Kingdom | 416/142 A |

*Primary Examiner*—Everette A. Powell, Jr.

*Attorney, Agent, or Firm*—Young & Thompson

[57] ABSTRACT

A boat propeller with foldable blades, a so-called folding propeller, in which the mounting axes of the blades in the hub are inclined towards the rotational axis of the hub, so that the blades are movable between their folded and unfolded positions by rotating essentially one-half turn.

9 Claims, 8 Drawing Figures

FOLDING BOAT PROPELLER

Figure 1:
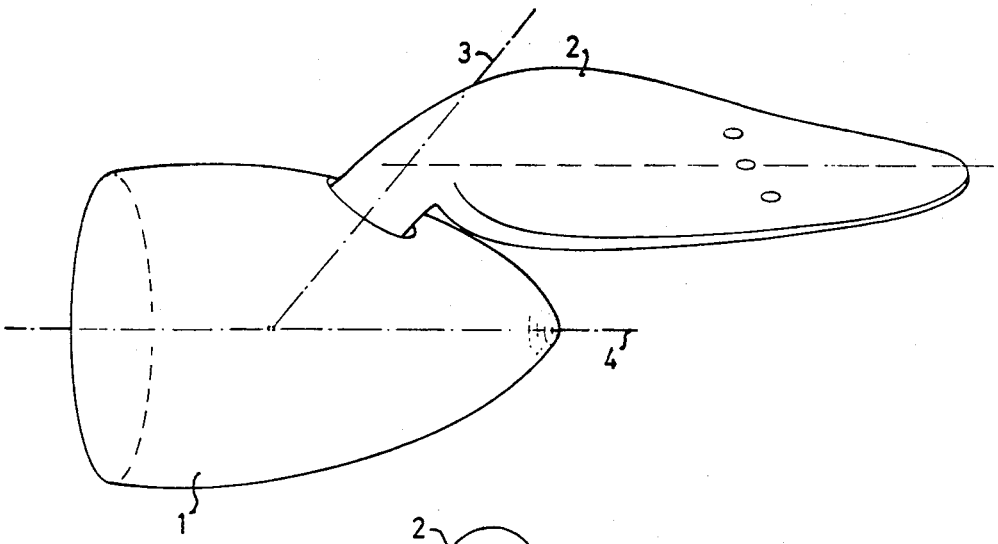

The present invention relates to a boat propeller comprising a hub designed to be attached on a propeller shaft and at least two propeller blades carried by the hub which are pivotally mounted so that they are movable between an extended operating position and a retracted position in which the blades extend backwards in the direction of the shaft.

Propellers of this type, so-called folding propellers, are used primarily in sailboats to reduce drag in the water during sailing. When the propeller shaft is not rotating during sailing, the blades are folded together against each other by the pressure of the water so as to form a spool-shaped extension of the propeller hub. When the motor is started and it drives the propeller shaft, centrifugal force is employed to fold out the blades.

Known propellers of the type described have their blades mounted on axes running perpendicular to the rotational axis of the hub, so that the folding-out is accomplished by swinging the blades about 90° in one plane.

This type of propeller requires heavy blades which are bulky and result in poorer propeller efficiency and problems with large striking forces when folding out for forward drive. A further substantial disadvantage is that the efficiency in reverse is significantly lower than in forward, since the flow force in reverse acts to fold the blades together and due to the thickness of the blades they have a heavily convex suction side.

The purpose of the present invention is to achieve a propeller of the type described in the introduction which, to eliminate the above-mentioned disadvantages, can be made with thin, light blades (thereby achieving a high efficiency), low moment of inertia about the axis of rotation (resulting in a low engagement torque), and low pressure pulses in the water.

This is achieved according to the invention by virtue of the fact that the mounting axes of the blades are arranged at such an angle relative to the rotational axis of the hub that the blades are movable between the unfolded and the folded positions by rotation about the respective mounting axis essentially one-half turn.

The invention is based on the insight that the flow force acting on a propeller blade is approximately perpendicular to a portion of the blade surface regardless of the operating conditions. In the propeller according to the invention, the blades when folded out move in a circular path which means that the blades move in a path which is always almost perpendicular to the flow force acting on the blades. Since in principle no work is required to carry out a movement perpendicular to an acting force, work being required to displace a force along its line of action, this means that the blades of the propeller according to the invention can be unfolded without theoretically requiring work during the folding-out process. To assure unfolding under all conditions, according to a preferred embodiment of the propeller according to the invention, the hub is provided with means for permitting a limited rotation of the hub relative to the propeller shaft, and transmission means which are arranged upon said relative movement to transmit torque to the propeller blades for turning them between the folded and the unfolded positions.

Figure 2:
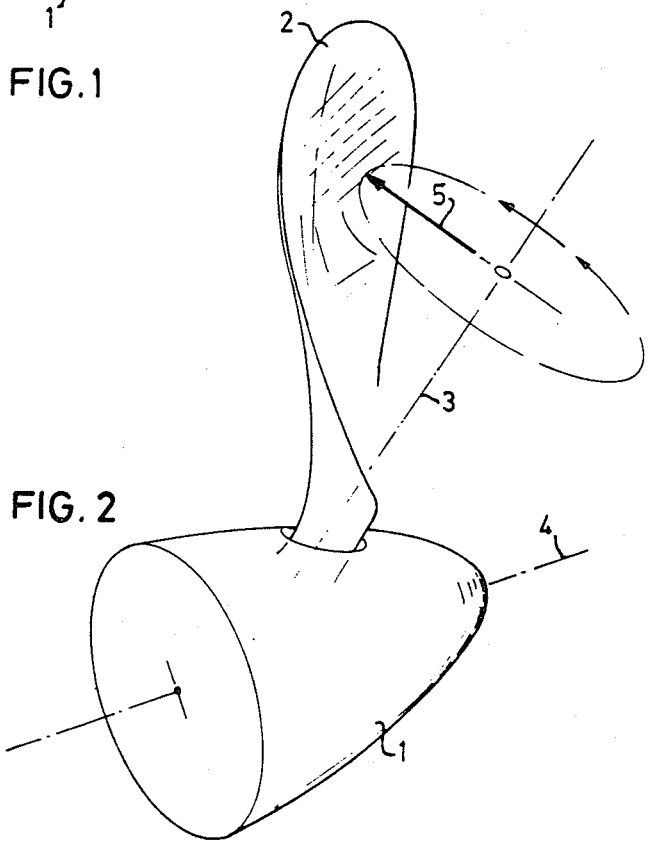
Figure 3B:
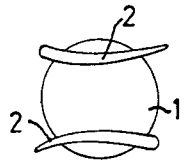
Figure 3A:
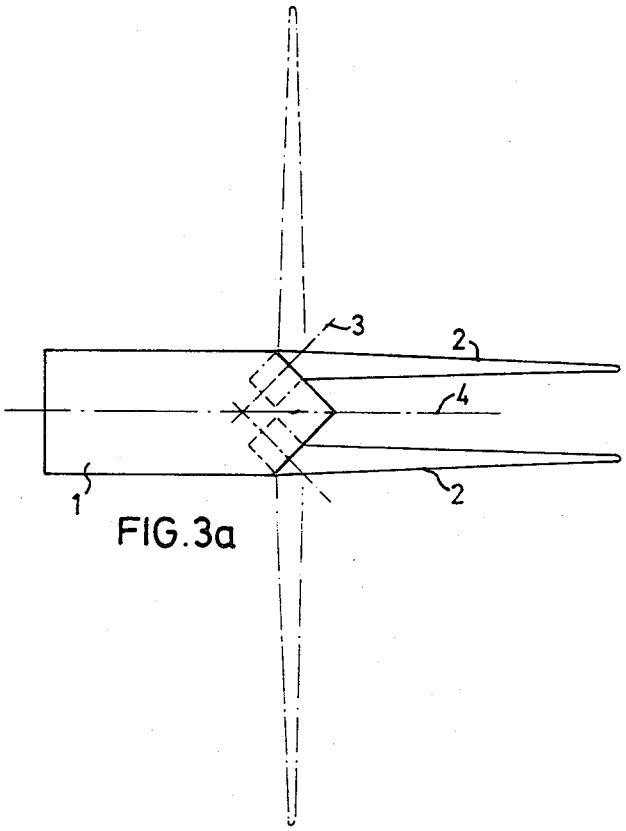
Figure 4B:
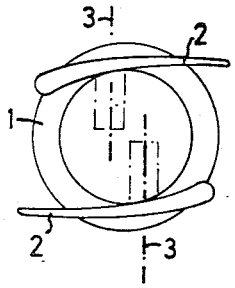
Figure 4A:
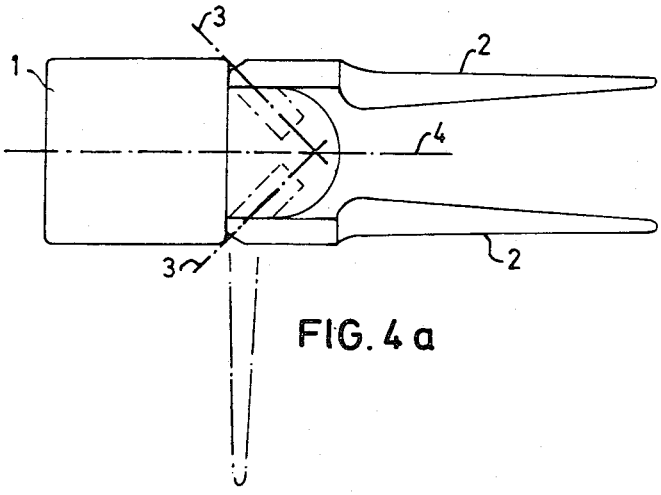
Figure 5:
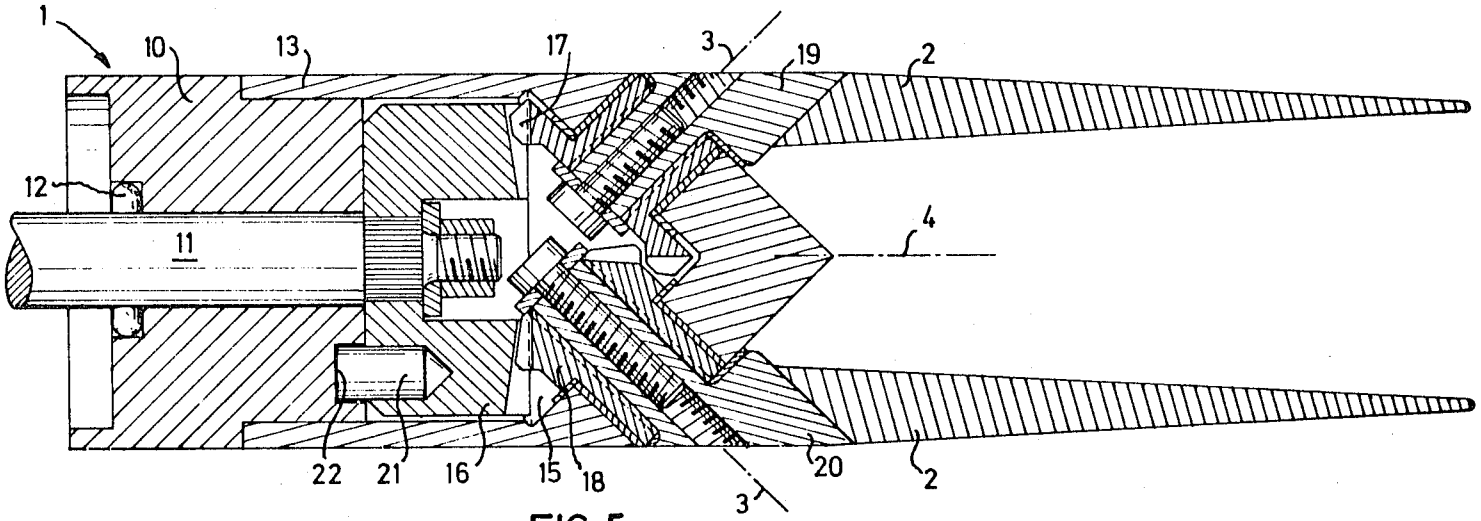
Figure 6:
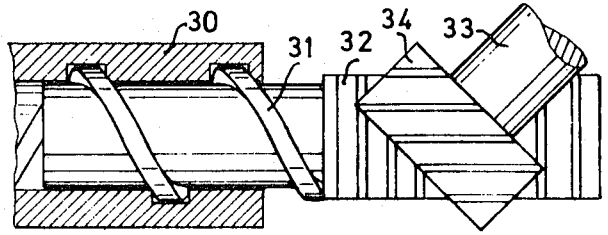

The invention will be described in more detail with reference to the examples shown in the accompanying drawings, in which FIG. 1 shows a schematic side view of a propeller hub with a blade shown in the folded position, FIG. 2 shows a view corresponding to FIG. 1 with the blade in the unfolded position, FIGS. *3a, 3b* and *4a, 4b* are schematic side views and end views respectively of two different embodiments of the propeller according to the invention, FIG. 5 is a longitudinal section through a propeller illustrating the transmission mechanism, and FIG. 6 is a schematic side view of a modified transmission mechanism.

FIGS. 1 and 2 show a propeller according to the invention, which comprises a hub 1 in which two, three or four blades 2 are pivotally mounted. For the sake of simplicity, only one of the blades is shown in the figures. In the example shown, the mounting axis 3 of the blade 2 is arranged at about a 45° angle to the rotational axis 4 of the hub 1, and also forms about a 135° angle with the longitudinal axis of the blade, so that the blade lies parallel to the axis 4 in the position shown in FIG. 1. If the blade is rotated one-half turn from this position, the blade is swung out to the position shown in FIG. 2, in which it forms a 90° angle with the rotational axis 4. As indicated in FIG. 2, the blade moves in a circular path, the movement always being approximately perpendicular to the flow force indicated by the arrow 5.

The propeller according to the invention can have two principally different placements of the blades, as illustrated in FIGS. *3a, 3b* and *4a, 4b*. In the example shown in FIGS. *3a, 3b* the mounting axes 3 of the blades 2 are inclined backwards 45° as in the example in FIGS. 1 and 2, resulting in the suction sides of the blades 2 facing each other in the folded position. FIGS. *4a, 4b* illustrate an embodiment in which the two bearing axes 3 of the blades are inclined forwards 45°, resulting in the pressure sides of the blades facing each other. In the first-mentioned example, the blade axes can be placed in the same or in different planes and the propeller can be provided with at most four blades which are pivotable 360°. In the second example, the blade axes 3 are in different planes (see FIG. *4b*) and the propeller can be provided with at most three blades which are pivotable 180°.

FIG. 5 shows a longitudinal section through a propeller according to the invention in a practical embodiment. The hub 1 has a hub portion 10 which is rotatably mounted on a propeller shaft 11 and is prevented from forward displacement on the shaft by a pin 12. A second hub portion 13, which carries two propeller blades 2, is securely fixed to the first hub portion 10. The hub portions define a cavity 15 in which there is a gear transmission which comprises a gear 16 securely fixed to the propeller shaft 11 and two gears 17,18 engaging said gear 16 and which are securely fixed to shafts 19,20 which are freely rotatably mounted in the hub portion 13 and are each securely fixed to an individual blade 2. The gear 16 is provided with a pin 21 which extends into a circular groove 22 in the hub portion 10. As can be seen in the figure, the gears 17,18 are of different sizes and engage the gear 16 at different radii. This makes a higher gear ratio possible and the geometry simplifies the tooth cutting of gear 16, which will be slightly conical.

In the example shown, the rotational axes 3 of the blades are inclined 45° backwards towards the rotational axis 4 of the hub, and the blades 2 are parallel to the axis 4 when folded. The gear ratio between the gear 16 and the gears 17,18 is 0.75:1 and the circular groove 22 extends 270°. When the blades are folded together, the pin 21 is halfway between the ends of the groove 22 and thus allows rotation of the gear 16 135° in either direction relative to the hub portion 10. With the gear ratio 0.75:1, this rotation results in a rotation of the blade shafts 19,20 of 180° in either direction thus unfolding the blades to a position perpendicular to the axis of rotation of the hub. Regardless of whether the propeller shaft is driven for forward or reverse, the reaction torque will result in folding-out of the blades.

Instead of the embodiment shown, the propeller can be provided with adjustable stops (not shown) for the pin 21, so that the angle of rotation of the blade shafts can be varied, thus changing the pitch.

FIG. 6 shows schematically another embodiment of a transmission for transmitting relative rotation between the propeller shaft and the hub to rotation of propeller blades. In the figure, 30 designates a nut which is securely fixed to the propeller shaft (not shown). The nut 30 engages a screw 31, the extension of which forms a toothed rack 32. A propeller blade shaft 33 is joined to a gear 34 which engages the rack 32. The rack is non-rotatably but axially displaceably mounted in a propeller hub (not shown) which, as in the preceding example, is limitedly rotatable relative to the propeller shaft. When the shaft is turned relative to the hub, the interaction between the nut 30 and the screw 31 will displace the rack 32 axially, turning the gear 34 and thus the blade shaft 33.

The invention is of course not limited to the above-described embodiments. The angle between the rotational axis of the propeller blades and the rotational axis of the hub can be varied within the range of about 35°–50°. Furthermore the propeller blades in the folded position can be inclined up to about 15° to the rotational axis of the hub. The transmission between the propeller shaft and the blades can comprise connecting arms, cam means etc. It is important that the friction can be kept low, since the reaction torque when the blades are folded is relatively low.

In a modified embodiment of the transmission in FIG. 5, the gear fixed to the propeller shaft can engage merely one of the blade shaft gears, with this gear in turn engaging the other blade shaft gear.

What we claim is:

1. Boat propeller comprising a hub for attachment to a propeller shaft and at least two propeller blades carried by said hub, each of which blades has a suction side and a pressure side, and which are pivotally mounted in the hub so that they are movable between an unfolded operating position and a folded position in which the blades extend rearwards in the direction of the shaft, characterized in that the mounting axes of the blades are arranged at such an angle relative to the rotational axis of the hub that the blades are movable between the unfolded and the folded positions by rotation about the respective mounting axis at least essentially one-half turn, the hub having means for permitting limited rotation of the hub relative to a said propeller shaft, and transmission means arranged, upon said relative movement, to transmit torque to the propeller blades for rotating them between the folded and the unfolded positions.

2. Boat propeller as claimed in claim 1, characterized in that the mounting axes are oriented relative to the blades so that the suction sides of the propeller blades face each other in the folded position.

3. Boat propeller as claimed in claim 1, characterized in that the mounting axes are oriented relative to the blades so that the pressure sides of the propeller blades face each other in the folded position.

4. Boat propeller as claimed in claim 1, characterized in that the angle of the mounting axes to the rotational axis of the hub is about 35°–50°.

5. Boat propeller as claimed in claim 4, characterized in that the longitudinal axes of the blades are essentially parallel to the rotational axis of the hub in the folded position of the blades.

6. Boat propeller as claimed in claim 1 characterized in that the blades are rotatable 360° in the hub, that means are arranged to limit the rotation of the hub relative to the propeller shaft to about 270°, and that the gear ratio of the transmission means is about 0.75:1.

7. Boat propeller as claimed in claim 1, characterized in that the hub houses a gear adapted to be non-rotatably joined to a said propeller shaft and the propeller blades have inclined shafts which carry gears, at least a first one of which engages the propeller shaft gear, the remaining gear engaging either one of said first gear and the propeller shaft gear.

8. Boat propeller as claimed in claim 7, characterized in that the gears of the blade shafts have different radii and engage the propeller shaft gear at different radii of the same.

9. Boat propeller as claimed in claim 1, characterized in that the propeller blades have inclined shafts that carry gears which engage a toothed rack displaceable mounted in the hub, said rack having a threaded portion engaging a nut member which is intended to be non-rotatably joined to a said propeller shaft.

* * * * *